US005439785A

United States Patent [19]

Boston et al.

[11] Patent Number: 5,439,785

[45] Date of Patent: Aug. 8, 1995

[54] PHOTOGRAPHIC ELEMENTS COMPRISING ANTISTATIC LAYERS OF VANADIUM PENTOXIDE, EPOXY-SILANE, AND SULFOPOLYMER

[75] Inventors: David R. Boston, Woodbury; William L. Kausch, Cottage Grove, both of Minn.; Elio Martino, Carcare, Italy; Eric D. Morrison, West St. Paul, Minn.; Alberto Valsecchi, Vado Ligure, Italy

[73] Assignee: Minnesota Mining and Manufacturing Company, St. Paul, Minn.

[21] Appl. No.: 277,097

[22] Filed: Jul. 19, 1994

Related U.S. Application Data

[63] Continuation of Ser. No. 49,941, Apr. 20, 1993, abandoned.

[51] Int. Cl.[6] ..... G03C 1/85; G03C 1/89

[52] U.S. Cl. ..... 430/530; 430/527; 430/529; 430/533; 430/529

[58] Field of Search ..... 430/527, 529, 530, 533, 430/629, 631, 634, 636

[56] References Cited

U.S. PATENT DOCUMENTS

| | | | |
|---|---|---|---|
| 3,561,967 | 2/1971 | Sakai et al. | 96/87 |
| 4,203,769 | 5/1980 | Guestaux | 430/631 |
| 4,865,948 | 9/1989 | Masumoto et al. | 430/270 |
| 4,971,885 | 11/1990 | Hammann, IV et al. | 430/631 |
| 5,006,451 | 4/1991 | Anderson et al. | 430/527 |
| 5,015,556 | 5/1992 | Martens | 430/306 |
| 5,187,044 | 2/1993 | Prioleau et al. | 430/271 |
| 5,203,884 | 4/1993 | Buchanan et al. | 525/255 |
| 5,204,219 | 4/1993 | Van Ooij et al. | 430/272 |
| 5,221,598 | 6/1993 | Anderson et al. | 430/533 |
| 5,284,741 | 2/1994 | Tachibana et al. | 430/529 |

FOREIGN PATENT DOCUMENTS

| | | | |
|---|---|---|---|
| 0127820 | 12/1984 | European Pat. Off. | 430/529 |
| 45-27036 | 9/1970 | Japan | 430/629 |
| 1159640 | 6/1989 | Japan | 430/529 |
| 3014803 | 1/1991 | Japan . | |
| 5-119433 | 5/1993 | Japan . | |
| WO93/24322 | 12/1993 | WIPO . | |

OTHER PUBLICATIONS

J. Livage, "Vanadium Pentoxide Gels", *Chem. Mater.*, 1991, 3, 578–593.

"Electric Moments of the Simple Alkyl Orthovanadates," Cartan et al., *J. Phys. Chem.*, 64, (1960), pp. 1756–1768.

"Mixed-Valence Polyvanadic Acid Gels," Gharbi et al., *Inorg. Chem.*, 21, (1982), pp. 2758–2765.

"Synthesis of Amorphous Vanadium Oxide From Metal Alkoxide", Hioki et al., *Nippon Seramikkusu Kyokai Gakujutsu Ronbunshi*, 97, (6), (1989), pp. 628–633 (English abstract provided).

"Synthesis of $V_2O_5$ Gels from Vanadyl Alkoxides", Hirashima et al., *Nippon Seramikkusu Kyokai Gakujutsu Ronbunshi*, 97, (1989), (3), pp. 235–238.

"Sol-Gel Synthesis of Vanadium Oxide from Alkoxides," Nabavi et al., *Eur. J. Solid State Inorg. Chem.*, 28, (1991), pp. 1173–1192.

Abstract for "Colloidal Vanadium Pentoxide," Ostermann, *Wiss. U. Ind., I*, (1922), pp. 17–19.

Abstract for "Vanadic Acid Esters and Some Other Organic Vanadium Compounds," Prandtl et al., *Z. Anorg. Chem.*, 82, pp. 103–129.

"Sythesis and Characterization of Vanadium Oxide Gels from Alkoxy-Vanadate Precursors," Sanchez et al., *Mat. Res. Soc. Symp. Proc.*, 121, (1988) pp. 93–104.

"The Preparation of Colloidal Vanadic Acid," Wegelin, *Z. Chem. Ind. Kolloide*, 2, (1912) pp. 25–28; and English abstract therefor.

"Preparation of Colloidal Vanadic Acid by a New Dispersion Method," Muller, *Z. Chem. Ind. Kolloide*, 8, (1911), pp. 302–303; and English abstract therefor.

Abstract Kons, G06 93-192304/24 JP05119433-A.

*Primary Examiner*—Charles L. Bowers, Jr.

*Assistant Examiner*—J. Pasterczyk

*Attorney, Agent, or Firm*—Gary L. Griswold; Walter N. Kirn; Susan Moeller Zerull

[57] ABSTRACT

Light-sensitive photographic element comprising a polymeric film base, a silver halide emulsion layer, and an antistatic layer comprising a colloidal vanadium oxide and a sulfopolyester. The antistatic layer may be present as a backing layer on the side of the base opposite the silver halide emulsion layer, as a subbing layer between the base and the emulsion layer in a single or double side coated photographic element, and/or as a subbing layer between the base and a different backing layer.

34 Claims, No Drawings

PHOTOGRAPHIC ELEMENTS COMPRISING ANTISTATIC LAYERS OF VANADIUM PENTOXIDE, EPOXY-SILANE, AND SULFOPOLYMER

This is a continuation of application Ser. No. 08/048,941 filed Apr. 20, 1993, now abandoned.

FIELD OF THE INVENTION

The present invention relates to light-sensitive photographic elements comprising antistatic layers, and in particular to light-sensitive photographic elements comprising antistatic layers containing colloidal vanadium oxide.

BACKGROUND OF THE ART

The use of polymeric film bases for carrying photographic layers is well known. In particular, photographic elements which require accurate physical characteristics use polyester film bases, such as polyethyleneterephthalate film bases, and cellulose ester film bases, such as cellulose triacetate film bases.

It is known that the formation of static electric charges on the film base is a serious problem in the production of photographic elements. While coating the light-sensitive emulsion, electric charges which accumulate on the base discharge, producing light which is recorded as an image on the light-sensitive layer. Other drawbacks which result from the accumulation of electric charges on polymeric film bases are the adherence of dust and dirt, coating defects and limitation of coating speed.

Additionally, photographic elements comprising light-sensitive layers coated onto polymeric film bases, when used in rolls or reels which are mechanically wound and unwound or in sheets which are conveyed at high speed, tend to accumulate static charges and record the light generated by the static discharges.

The static-related damages occur not only before the photographic element has been manufactured, exposed and processed, but also after processing when the photographic element including the image is used to reproduce and enlarge the image. Accordingly, it is desired to provide permanent antistatic protection which retains its effectiveness even after processing.

To overcome the adverse effects resulting from accumulation of static electrical charges, it is known to provide photographic elements with antistatic layers including electrically conductive materials which are capable of transporting charges away from areas where they are not desired. Typically, such antistatic layers contain electrically conductive substances, in particular polyelectrolytes such as the alkali metal salts of polycarboxylic acids or polysulfonic acids, or quaternary ammonium polymers, which dissipate the electrical charge by providing a surface which conducts electrons by an ionic mechanism. However, such layers are not very suitable as antistatic layers because they lose effectiveness under conditions of low relative humidity, become sticky under conditions of high relative humidity, and lose their antistatic effect after passage through processing baths.

It is known in the art that preferred antistatic materials are those that conduct electrons by a quantum mechanical mechanism rather that an ionic mechanism. This is because antistatic materials that conduct electrons by a quantum mechanical mechanism are effectively independent of humidity. They are suitable for use under conditions of low relative humidity, without losing effectiveness, and under conditions of high relative humidity, without becoming sticky. Defect semiconductor oxides and conductive polymers have been proposed as electronic conductors which operate independent of humidity. A major problem, however, with such electronic conductors is that they generally cannot be provided as thin, transparent, relatively colorless coatings by solution coating methods. The use of vanadium oxide has proved to be the one exception. That is, effective antistatic coatings of vanadium oxide can be deposited in transparent, substantially colorless thin films by coating from aqueous dispersions.

It is known to prepare an antistatic layer from an aqueous composition comprising vanadium oxide as described, for example, in FR Patent Application No. 2,277,136, BE Patent No. 839,270, U.S. Pat. No. 4,203,769 and GB Patent Application No. 2,032,405. The composition comprising the vanadium oxide may contain a binder to improve mechanical properties of an antistatic layer produced therefrom, such as cellulose derivatives, polyvinyl alcohols, polyamides, styrene and maleic anhydride copolymers, copolymer latexes of alkylacrylate, vinylidene chloride and itaconic acid. It is also known to provide such vanadium oxide antistatic layers with a protective overcoat layer that provides abrasion protection and/or enhances frictional characteristics, such as a layer of cellulosic material.

In photographic elements, the antistatic layer comprising vanadium oxide can be located on the side of the film base opposite to the image-forming layer as outermost layer, with or without a protective abrasion-resistant topcoat layer, or can be located as a subbing layer underlying a silver halide emulsion layer or an auxiliary gelatin layer. As vanadium oxide can diffuse from the antistatic layer through the overlying protective layer or gelatin layer into the processing solutions, a diminution or loss of the desired antistatic protection results.

U.S. Pat. No. 5,006,451 describes a photographic material comprising a film base having thereon an antistatic layer comprising vanadium oxide and a barrier layer which overlies the antistatic layer and is comprised of a latex polymer having hydrophilic functionality. This patent reports that said barrier layer prevents the vanadium oxide from diffusing out of the underlying antistatic layer and thereby provides permanent antistatic protection. However, the solution provided by said patent requires a two layer contruction which requires additional investment and operating cost, and has been proved by experiments that it loses antistatic protection in certain processing solutions such as color photographic processing solutions.

Accordingly, there is still the need to provide single layer antistatic layers, using vanadium oxide, which give permanent antistatic protection in all photographic processing solutions.

SUMMARY OF THE INVENTION

The present invention relates to a light-sensitive photographic element comprising a polymeric film base, a silver halide emulsion layer, and an antistatic layer comprising colloidal vanadium oxide and a sulfopolyester. The antistatic layer may be present as a backing layer on the side of the base opposite the silver halide emulsion layer, as a subbing layer between the base and the emulsion layer in a single or double side coated photographic element, and/or as a subbing layer between the base and a different backing layer.

It has been discovered that the antistatic layer of the present invention provides permanent antistatic protection in any type of photographic processing solutions without the need of a barrier layer for preventing diffusion of vanadium oxide from the antistatic layer.

DETAILED DESCRIPTION OF THE INVENTION

The present invention relates to a light sensitive photographic element, especially a silver halide photographic element. The polymeric film base comprises a polymeric substrate such as a polyester, and especially such as polyethyleneterephthalate. Other useful polymeric film bases include cellulose acetates, especially cellulose triacetate, polyolefins, polycarbonates and the like. The polymeric film base has an antistatic layer adhered to one or both major surfaces of the base. A primer layer or a subbing layer may be used between the base and the antistatic layer. It has been found, however, that the antistatic layer according to the present invention has good adhesion to the polymeric film base without the need of primer or subbing layers.

The antistatic layer of the present invention comprises a colloidal vanadium oxide and a sulfopolyester.

Colloidal vanadium oxide useful in the antistatic layer according to the present invention means a colloidal dispersion in water of single or mixed valence vanadium oxide, wherein the formal oxidation states of vanadium ions are typically +4 and +5. In the art, such species are often referred to as $V_2O_5$. In the aged colloidal form (several hours at 80° C. or more or several days at room temperature), vanadium oxide consists of dispersed fibrillar particles of vanadium oxide which preferably have a thickness in the range of 0.02–0.08 micrometers and length up to 4 micrometers.

The colloidal vanadium oxide dispersions preferably are formed by hydrolysis and condensation reactions of vanadium oxide alkoxides. Most preferred colloidal vanadium oxide dispersions are prepared by hydrolyzing vanadium oxoalkoxides with a molar excess of deionized water. In preferred embodiments, the vanadium oxoalkoxides are prepared in situ from a vanadium oxide precursor species and an alcohol. The vanadium oxide precursor species is preferably a vanadium oxyhalide or vanadium oxyacetate. If the vanadium oxoalkoxide is prepared in situ, the vanadium oxoalkoxide may also include other ligands such as acetate groups.

Preferably, the vanadium alkoxide is a trialkoxide of the formula $VO(OR)_3$, wherein each R is independently an aliphatic, aryl, heterocyclic, or arylalkyl group. Preferably, each R is independently selected from the group consisting of $C_{1-10}$ alkyls, $C_{1-10}$ alkenyls, $C_{1-10}$ alkynyls, $C_{1-18}$ aryls, $C_{1-18}$ arylalkyls, or mixtures thereof, which can be substituted or unsubstituted. "Group" means a chemical species that allows for substitution or which may be substituted by conventional substituents which do not interfere with the desired product. More preferably, each R is independently an unsubstituted $C_{1-6}$ alkyl. When it is said that each R is "independently" selected from a group, it is meant that not all R groups in the formula $VO(RO)_3$ are required to be the same. "Aliphatic" means a saturated or unsaturated linear, branched, or cyclic hydrocarbon or heterocyclic radical. This term is used to encompass alkyls, alkenyls such as vinyl radicals, and alkynyls, for example. The term "alkyl" means a saturated linear, branched, or cyclic hydrocarbon radical. The term "alkenyl" means linear, branched, or cyclic hydrocarbon radical containing at least one carbon-carbon double bond. The term "alkynyl" means a linear or branched hydrocarbon radical containing at least one carbon-carbon triple bond. The term "heterocyclic" means a mono- or polynuclear cyclic radical containing carbon atoms and one or more heteroatoms such as nitrogen, oxygen, sulfur or a combination thereof in the ring or rings, such as furan, thymine, hydantoin, and thiophene. The term "aryl" means a mono- or polynuclear aromatic hydrocarbon radical. The term "arylalkyl" means a linear, branched, or cyclic alkyl hydrocarbon radical having a mono- or polynuclear aromatic hydrocarbon or heterocyclic substituent. The aliphatic, aryl, heterocyclic, and arylalkyl groups can be unsubstituted, or they can be substituted with various groups such as Br, Cl, F, I, OH groups, or other groups which do not interfere with the desired product.

The hydrolysis process results in condensation of the vanadium oxoalkoxides to vanadium oxide colloidal dispersions. It can be carried out in water within a temperature range in which the solvent, which preferably is deionized water or a mixture of deionized water and a water-miscible organic solvent, is in a liquid form, e.g., within a range of about 0°–100° C. The process is preferably and advantageously carried out within a temperature range of about 20°–30° C., i.e., at about room temperature. The hydrolysis preferably involves the addition of a vanadium oxoalkoxide to deionized water. The deionized water or mixture of deionized water and water-miscible organic solvents may contain an effective amount of a hydroperoxide, such as $H_2O_2$. Preferably, the deionized water and hydroperoxide are combined with a water-miscible organic solvent, such as a low molecular weight ketone or an alcohol. Optionally, the reaction mixture also can be modified by the addition of co-reagents, addition of metal dopants, by subsequent aging or heat treatments, and removal of alcohol by-products. By such modifications the vanadium oxide colloidal dispersion properties can be varied.

The vanadium oxoalkoxides can also be prepared in situ from a vanadium oxide precursor species in aqueous medium and an alcohol. For example, the vanadium oxoalkoxides can be generated in the reaction flask in which the hydrolysis, and subsequent condensation, reactions occur. That is, the vanadium oxoalkoxides can be generated by combining a vanadium oxide precursor species, such as, for example, a vanadium oxyhalide ($VOX_3$), preferably $VOCl_3$, or vanadium oxyacetate ($VO_2OAc$), with an appropriate alcohol, such as i-BuOH, i-PrOH, n-PrOH, n-BuOH, t-BuOH, and the like, wherein Bu=butyl and Pr=propyl. It is understood that if vanadium oxoalkoxides are generated in situ, they may be mixed alkoxides. For example, the product of the in situ reaction of vanadium oxyacetate with an alcohol is a mixed alkoxide/acetate. Thus, herein the term "vanadium oxoalkoxide" is used to refer to species that have at least one alkoxide (—OR) group, particularly if prepared in situ. Preferably, the vanadium oxoalkoxides are trialkoxides with three alkoxide groups.

The in situ preparations of the vanadium oxoalkoxides are preferably carried out under an inert atmosphere, such as nitrogen or argon. The vanadium oxide precursor species is typically added to an appropriate alcohol at room temperature. When the reaction is exothermic, it is added at a controlled rate such that the reaction mixture temperature does not greatly exceed room temperature if the reaction is exothermic. The temperature of the reaction mixture can be further controlled by placing the reaction flask in a constant temperature bath, such as an ice water bath. The reaction of the vanadium oxide species and the alcohol can be done in the presence of an oxirane, such as propylene oxide, ethylene oxide, or epichlorohydrin, and the like. The oxirane is effective at removing by-products of the reaction of the vanadium oxide species, particularly vanadium dioxide acetate and vanadium oxyhalides, with alcohols. If desired, volatile starting materials and reaction products can be removed through distillation or evaporative techniques, such as rotary evaporation. The resultant vanadium oxoalkoxide product, whether in the form of a solution or a solid residue after the use of distillation or evaporative techniques, can be added directly to water to produce the vanadium oxide colloidal dispersions for use in the present invention.

The method of producing colloidal vanadium oxide dispersions involves adding a vanadium oxoalkoxide to a molar excess of water, preferably with stirring until a homogeneous colloidal dispersion forms. By a "molar excess" of water, it is meant that a sufficient amount of water is present relative to the amount of vanadium oxoalkoxide such that there is greater that a 1:1 molar ratio of water to vanadium-bound alkoxide. Preferably, a sufficient amount of water is used such that the final colloidal dispersion formed contains less that about 4.5 wt percent and at least a minimum effective amount of vanadium. This typically requires a molar ratio of water to vanadium alkoxide of at least 45:1, and preferably at least about 150:1. Herein, by "minimum effective amount" of vanadium it is meant that colloidal dispersions contain an amount of vanadium in the form of vanadium oxide, whether diluted or not, which is sufficient to form an effective sulfopolyester containing antistatic layer of the present invention.

In preparing preferred embodiments of the vanadium oxide colloidal dispersions, a sufficient amount of water is used such that the colloidal dispersion formed contains about 0.05 wt percent to about 3.5 wt percent vanadium. Most preferably, a sufficient amount of water is used so that the colloidal dispersion formed upon addition of the vanadium-containing species contains about 0.6 wt percent to about 1.7 wt percent vanadium.

In processes for preparing colloidal vanadium oxide dispersions, the vanadium oxoalkoxides are preferably hydrolyzed by adding the vanadium oxoalkoxides to the water, as opposed to adding the water to the vanadium oxoalkoxides. This is advantageous because it typically results in the formation of a desirable colloidal dispersion and generally avoids excessive gelling.

As long as there is a molar excess of water used in the hydrolysis and subsequent condensation reactions of the vanadium oxoalkoxides, water-miscible organic solvents can also be present. That is, in certain preferred embodiments the vanadium oxoalkoxides can be added to a mixture of water and a water-miscible organic solvent. Miscible organic solvents include, but are not limited to, alcohols, low molecular weight ketones, dioxane, and solvents with a high dielectric constant, such as acetonitrile, dimethylformamide, dimethylsulfoxide, and the like. Preferably, the organic solvent is acetone or an alcohol, such as i-BuOH, i-PrOH, n-PrOH, t-BuOH, and the like.

Preferably, the reaction mixture also contains an effective amount of hydroperoxide, such as $H_2O_2$ or t-butyl hydrogen peroxide. The presence of the hydroperoxide appears to improve the dispersive characteristics of the colloidal dispersion and facilitate production of an antistatic coating with highly desirable properties. That is, when an effective amount of hydroperoxide is used the resultant colloidal dispersions are less turbid, and more well dispersed. Preferably, the hydroperoxide is present in amount such that the molar ratio of vanadium oxoalkoxide to hydroperoxide is within a range of about 1:1 to 4:1.

Other methods known for the preparation of vanadium oxide colloidal dispersions, which are less preferred, include inorganic methods such as ion exchange acidification of $NaVO_3$, thermohydrolysis of $VOClO_3$, and reaction of $V_2O_5$ with $H_2O_2$. To provide coatings with effective antistatic properties from dispersions prepared with inorganic precursors typically requires substantial surface concentrations of vanadium, which generally results in the loss of desirable properties such as transparency, adhesion, and uniformity.

The other component of the antistatic layer according to the present invention is a water dispersible sulfopolyester. A wide variety of known water dispersible sulfopolyesters can be used. They include a polyester comprising at least one unit containing a salt of a $-SO_3H$ group, preferably as an alkali metal or ammonium salt. In some instances, these sulfopolyesters are dispersed in water in conjunction with an emulsifying agent and high shear to yield a stable emulsion; sulfopolyesters may also be completely water soluble. Additionally, stable dispersions may be produced in instances where sulfopolyesters are initially dissolved in a mixture of water and an organic cosolvent, with subsequent removal of cosolvent yielding an aqueous sulfopolyester dispersion.

Sulfopolyesters disclosed in U.S. Pat. Nos. 3,734,874, 3,779,993, 4,052,368, 4,104,262, 4,304,901, 4,330,588, for example, relate to low melting (below 100° C.) or noncrystalline sulfopolyester which may be dispersed in water according to methods mentioned above. In general, sulfopolyesters of this type may be best described as polymers containing units (all or some of the units in a copolymer) of the following formula:

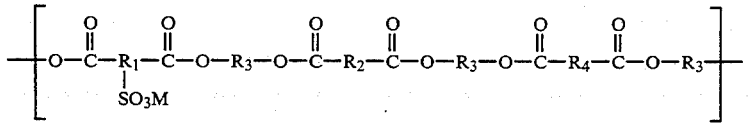

where

M can be an alkali metal cation such as sodium, potassium, or lithium; or suitable tertiary, and quaternary ammonium cations having 0 to 18 carbon atoms, such as ammonium, hydrazonium, N-methyl pyridinium, methylammonium, butylammonium, diethylammonium, triethylammonium, tetraethylammonium, and benzyltrimethylammonium.

$R_1$ can be an arylene group or aliphatic group incorporated in the sulfopolyester by selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanoic acid; and sulfoarenedicarboxylic acids such as 5'-sulfoisophthalic acid, 2-sulfoterephthalic acid, 5-sulfonaphthalene-1,4-dicarboxylic acid; sulfobenzylmalonic acid esters such as those described in U.S. Pat. No. 3,821,281; sulfophenoxymalonate such as described in U.S. Pat. No. 3,624,034; and sulfofluorenedicarboxylic acids such as 9,9-di-(2'-carboxyethyl)-fluorene-2-sulfonic acid. It is to be understood that the corresponding lower alkyl carboxylic esters of 4 to 12 carbon atoms, halides, anhydrides, and sulfo salts of the above sulfonic acids can also be used.

$R_2$ can be optionally incorporated in the sulfopolyester by the selection of one or more suitable arylenedicarboxylic acids, or corresponding acid chlorides, anhydrides, or lower alkyl carboxylic esters of 4 to 12 carbon atoms. Suitable acids include the phthalic acids (orthophthalic, terephthalic, isophthalic), 5-t-butyl isophthalic acid, naphthalic acids (e.g., 1,4- or 2,5-naphthalene dicarboxylic), diphenic acid, oxydibenzoic acid, anthracene dicarboxylic acids, and the like. Examples of suitable esters or anhydrides include dimethyl isophthalate or dibutyl terephthalate, and phthalic anhydride.

$R_3$ can be incorporated in the sulfopolyester by the selection of one or more suitable diols including straight or branched chain alkylenediols having the is formula $HO(CH_2)_nOH$ in which n is an integer of 2 to 12 and oxaalkylenediols having the formula $H—(OR_5)_m—OH$ in which $R_5$ is an alkylene group having 2 to 4 carbon atoms and m is an integer of 1 to 6, the values being such that there are no more than 10 carbon atoms in the oxaalkylenediol. Examples of suitable diols include ethyleneglycol, propyleneglycol, 1,5-pentanediol, 1,6-hexanediol, 1,8-octanediol, 1,10-decanediol, 2,2-dimethyl-1,3-propanediol, 2,2-diethyl-1,3-propanediol, 3-methyl-1,5-pentanediol, diethyleneglycol, dipropyleneglycol, diisopropyleneglycol, and the like. Also included are suitable cycloaliphatic diols such as 1,4-cyclohexanedimethanol, 1,3-cyclohexanedimethanol, and the like. Suitable polyester or polyether polyols may be used such as polycaprolactone, polyneopentyl adipate, or polyethyleneoxide diols up to 4000 in molecular weight, and the like; generally these polyols are used in conjunction with lower molecular weight diols such as ethylene glycol if high molecular weight polyester are desired.

$R_4$ can be incorporated in the sulfopolyester by the selection of suitable aliphatic or cycloaliphatic dicarboxylic acids or corresponding acid chlorides, anhydrides or ester derivatives; such as acids having the formula $HOOC(CH_2)_oCOOH$, wherein o is an integer having an average value of 2 to 8 (e.g., succinic acid, adipic acid, maleic acid, glutaric acid, suberic acid, sebacic acid, and the like). Suitable cycloaliphatic acids include cyclohexane-1,4-dicarboxylic acid, and the like.

The sulfopolyesters used in the present invention can be prepared by standard techniques, typically involving the reaction of dicarboxylic acids (or diesters, anhydrides, etc. thereof) with monoalkylene glycols and/or polyols in the presence of acid or metal catalysts (e.g., antimony trioxide, zinc acetate, p-toluene sulfonic acid, etc.), utilizing heat and pressure as desired. Normally, an excess of the glycol is supplied and removed by conventional techniques in the later stages of polymerization. When desired, a hindered phenol antioxidant may be added to the reaction mixture to protect the polyester from oxidation. To ensure that the ultimate polymer will contain more than 90 mole % of the residue of monoalkylene glycols and/or polyols, a small amount of a buffering agent (e.g., sodium acetate, potassium acetate, etc.) is added. While the exact reaction mechanism is not known with certainty, it is thought that the sulfonated aromatic dicarboxylic acid promotes the undesired polymerization of the glycol per se and that this side reaction is inhibited by a buffering agent.

The coating composition for preparing the antistatic layer according to this invention can be prepared by dispersing the sulfopolyester in water, optionally with water-miscible solvent (generally less than 50 weight percent cosolvent). The dispersion can contain more than zero and up to 50 percent by weight sulfopolyester, preferably in the range of 10 to 25 weight percent sulfopolyester. Organic solvents miscible with water can be added. Examples of such organic solvents that can be used include acetone, methyl ethyl ketone, methanol, ethanol, and other alcohols and ketones. The presence of such solvents is desirable when need exists to alter the coating characteristics of the coating solution.

For preparation of the mixture of colloidal vanadium oxide and sulfopolyester a most preferred colloidal dispersion of vanadium oxide can be prepared, as noted above, by the hydrolysis of a vanadium oxoalkoxide with a molar excess of deionized water. A preferred preparation is the addition of vanadium iso-butoxide to a hydrogen peroxide solution, as described in detail below. The vanadium oxide dispersion can be diluted with deionized water to a desired concentration before mixing with the aqueous sulfopolyester dispersion. Dispersions containing very small amounts of vanadium oxide can provide useful coating for the present invention. In all cases the amount of vanadium oxide present is sufficient to confer antistatic properties to the final coating. The use of deionized water avoids problems with flocculation of the colloidal particles in the dispersions. Deionized water has had a significant amount of $Ca^{2+}$ and $Mg^{2+}$ ions removed. Preferably, the deionized water contains less than about 50 ppm of these multivalent cations, most preferably less than 5 ppm.

The sulfopolyester dispersion and the vanadium oxide dispersion are mixed together. Generally, this involves stirring the two dispersions together for sufficient time to effect complete mixing. If other materials or particles are to be incorporated into the coating mixture, however, it is frequently more convenient to stir the mixture for several hours by placing the mixture into a glass jar containing several glass beads and roll milling it. Surfactants can be added at the mixing step. Any water compatible surfactant, except those of high acidity or basicity or complexing ability, or which otherwise would interfere with the desired element, is suitable for the practice of this invention. A suitable surfactant does not alter the antistatic characteristics of the coating, but allows for the uniform wetting of a substrate surface by the coating solution. Depending upon the substrate, wetting out completely can be difficult, so it is sometimes convenient to alter the coating composition by the addition of organic solvents. It is apparent to those skilled in the art that the addition of various solvents is acceptable, as long as it does not cause flocculation or precipitation of the sulpopolyester or the vanadium oxide.

Alternatively, the vanadium oxide dispersion can be generated in the presence of a sulfopolyester by, for example, the addition of $VO(OiBu)_3$ (vanadium triisobutoxide oxide) to a dispersion of polymer, optionally containing hydrogen peroxide, and aging this mixture at 50° C. for several hours to several days. In this way, colloidal vanadium oxide dispersions can be prepared in situ with dispersions with which they might otherwise be incompatible, as evidenced by flocculation of the colloidal dispersion. Alternatively, this method simply may be a more convenient preparation method for some dispersions.

The sulfopolyester/vanadium oxide compositions can contain any percent by weight solids. For ease of coatability, these compositions preferably comprise more than zero (as little as about 0.05 weight percent, preferably as little as 0.15 weight percent, solids can be useful) and up to about 15 percent by weight solids. More preferably, the compositions comprise more than zero and up to 10 weight percent solids, and most preferably more than zero and up to 6 weight percent solids. In the dried solids the weight ratio of vanadium oxide to sulfopolyester may vary from 1:20 to 1:150, preferably from 1:30 to 1:100. Higher values of vanadium oxide/sulfopolyester weight ratios give poor antistatic performance after processing. Lower values of vanadium oxide/sulfopolyester weight ratios gives poor antistatic performance even before processing.

The coatings prepared from the colloidal vanadium oxide/sulfopolyester dispersions of the antistatic layer according to the present invention typically contain whisker shaped colloidal particles of vanadium oxide. These particles can have a high aspect ratio, (i.e., greater than 10 and even as high as 200) and are generally evenly distributed. The colloidal particles were examined by field emission scanning electron microscopy. The micrographs of some samples of vanadium oxide dispersions showed evenly dispersed, whisker-shaped colloidal particles of vanadium oxide, approximately 0.02 to 0.08 micrometers wide and 1.0 to 4.0 micrometers long. This invention, however, is not limited to those dimensions of vanadium oxide particles, as one of ordinary skill in the art can readily adjust the synthetic process to alter the dimensions of the particles.

These dispersions can be coated by dip coating, spin coating, or roll coating. Coatings can also be formed by spray coating, although this is less preferred.

Once the dispersion is coated out, the coated film can be dried, generally at a temperature from room temperature up to a temperature limited by film base and sulfopolyester, preferably room temperature to 200° C., most preferably 50 to 150° C., for a few minutes. The dried coating weight preferably can be in the range of 10 mg/m$^2$ to 1 g/m$^2$.

The antistatic layer of the present invention may contain other addenda which do not influence the antistatic properties of the layer, such as, for example, matting agents, plasticizers, lubricants, dyes, and haze reducing agents. In particular, when the antistatic layer must function as both a subbing layer and an antistatic layer underlying an auxiliary gelatin layer or a silver halide emulsion layer, it may be advantageous to add an adhesion promoter to the antistatic layer in order to provide good adhesion of the emulsion layer or the gelatin layer which overlies it.

Preferred adhesion promoters in the antistatic layer of the present invention are epoxy-silane compounds represented by the following general formulae:

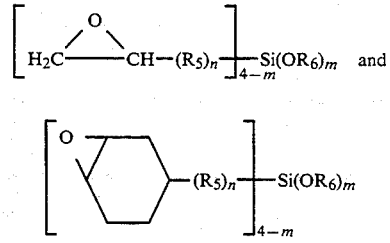

wherein:

$R_5$ is a divalent hydrocarbon radical of less than 20 carbon atoms (the backbone of which is composed only of carbon atoms or of nitrogen, sulfur, silicon and oxygen atoms in addition to carbon atoms with no adjacent heteroatoms within the backbone of said divalent radical except silicon and oxygen), $R_6$ is hydrogen, an aliphatic hydrocarbon radical of less than 10 carbon atoms or an acyl radical of less than 10 carbon atoms, n is 0 or 1, and m is an integer of 1 to 3, the most preferred epoxy-silane compounds being those of formulae

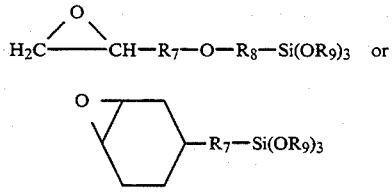

wherein:

$R_7$ and $R_8$ are independently alkylene groups of 1 to 4 carbon atoms, and $R_9$ is hydrogen or an alkyl group of 1 to 10, most preferably 1 to 4 carbon atoms.

Examples of divalent radicals represented by $R_5$ in the above formulae include methylene, ethylene, decalene, phenylene, cyclohexylene, cyclopentene, methylcyclohexylene, 2-ethylbutylene and allene, an ether radical such as: $—CH_2—CH_2—O—CH_2—CH_2—$, $—(CH_2—CH_2—O)_2—CH_2—CH_2—$, $—C_6H_4—O—CH_2—CH_2—$ and $—CH_2—O—(CH_2)_3—$, or a siloxane radical such as: $—CH_2(CH_3)_2Si—O—$, $—(CH_2)_2(CH_2)_2Si—O—$, $—(CH_2)_3(CH_3)_2Si—O—$.

Examples of aliphatic hydrocarbon radicals represented by $R_6$ include methyl, ethyl, isopropyl, butyl, and examples of acyl radicals represented by $R_6$ include formyl, acetyl, propionyl.

The epoxy-silane compounds useful in the present invention are preferably gamma-glycydoxypropyl-trimethoxy-silane and $\beta$-(3,4-epoxycyclohexyl)ethyl-trimethoxy-silane, the most preferred being $\gamma$-glycydoxypropyl-trimethoxy-silane.

The epoxy-silane compounds described above can be prepared according to methods known in the art, such as for example the methods described in W. Noll, *Chem-*

*istry and Technology of Silicones,* Academic Press (1968), pp. 171-3, and in Journal of American Chemical Society, vol. 81 (1959). p. 2632.

Epoxy-silane compounds may be added to the coating solution containing vanadium oxide and sulfopolyester as neat liquids or solids or as solutions in suitable solvents. The epoxy-silane compounds may be hydrolyzed completely or partially before addition. By "partially hydrolyzed" it is meant that not all of the hydrolyzable silicon-alkoxide or silicon-carboxylate groups have been removed from the silane by reaction with water. Hydrolysis of epoxy-silane compounds is conveniently done in the presence of water and a catalyst such as an acid, a base, or fluoride ion. The hydrolyzed epoxy-silane compounds may exist as siloxane polymers or oligomers resulting from condensation of silanol groups produced in the hydrolytic reaction of the epoxy-silane compound with other silanol groups or with unreacted silicon-alkoxide or silicon-carboxylate bonds. It may be desirable to add epoxy-silane compounds in the form of co-hydrolysates or co-hydrolysates and co-condensates with other, non-epoxy silane compounds.

The proportions of epoxy-silane compound in the antistatic layer according to this invention can be widely varied to meet the requirements of the particular photographic element or polymeric film base which is to be provided with an antistatic layer. Typically, the weight ratio of epoxy-silane to sulfopolyester will be in the range of about 0.1 to about 0.6, and preferably of about 0.2 to about 0.4.

Other useful adhesion promoters include non-silane epoxy compounds such as polyethylene glycol diglycidyl ethers, bis-phenol A diepoxide, epoxy containing polymers, epoxy containing polymer lattices, and epoxy functional monomers.

Polymeric film bases for the practice of this invention include polyesters such as polyethyleneterephthalate (PET), copolyesters, polyamide, polyimide, polyepoxydes, polycarbonate, polyolefins such as polyvinyl chloride, polyvinylidene chloride, polystyrene, polypropylene, polyethylene, or polyvinylacetate, polyacrylates such as polymethylmethacrylate, and cellulose esters such as cellulose triacetate.

The photographic elements useful in this invention may be any of the well-known silver halide photographic elements for imaging in the field of graphic arts, printing, color, medical and information systems.

Typical imaging element constructions of the present invention comprise:

1. The film base with an antistatic layer on one surface and the photographic silver halide emulsion layer or layers on the other surface of the film base. In this construction an auxiliary layer may or may not be present over the antistatic layer. Examples of auxiliary layers include backing antiscratching or slipping layers and backing gelatin antihalation layers.
2. The film base with an antistatic layer on one surface and at least one silver halide emulsion layer adhered to the same surface as the antistatic layer, over the antistatic layer.
3. The film base with antistatic layers on both surfaces of the polymeric film base and at least one photographic silver halide emulsion layer on one or both sides of the film base, over said antistatic layers.

The silver halides employed in this invention may be any one for use in silver halide photographic emulsions, such as silver chloride, silver bromide, silver iodide, silver chlorobromide, silver chloroiodide, silver iodobromide and silver chloroiodobromide.

The grains of these silver halides may be coarse or fine, and the grain size distribution of them may be narrow or extensive. Further, the silver halide grains may be regular grains having a regular crystal structure such as cube, octahedron, and tetradecahedron, or the spherical or irregular crystal structure, or those having crystal defects such as twin planes, or those having a tabular form, or combination thereof. Furthermore, the grain structure of the silver halides may be uniform from the interior to exterior thereof, or be multilayer. According to a simple embodiment, the grains may comprise a core and a shell, which may have different halide compositions and/or may have undergone different modifications such as the addition of dopants. Besides having a differently composed core and shell, the silver halide grains may also comprise different phases inbetween. Furthermore, the silver halides may be of such a type as allows a latent image to be formed mainly on the surface thereof or such a type as allows it to be formed inside the grains thereof.

The silver halide emulsions which can be utilized in this invention may be prepared according to different methods as described in, for example, *The Theory of the Photographic Process,* C. E. K. Mees and T. H. James, Macmillan (1966), *Chimie et Physique Photographique,* P. Glafkides, Paul Montel (1967), *Photographic Emulsion Chemistry,* G. F. Duffin, The Focal Press (1966), *Making and Coating Photographic Emulsion,* V. L. Zelikman, The Focal Press (1966), in U.S. Pat. No. 2,592,250 or in GB Pat. No. 635,841.

The emulsions can be desalted to remove soluble salts in the usual ways, e.g., by dialysis, by flocculation and re-dispersing, or by ultrafiltration, but emulsions still having soluble salts are also acceptable.

As the binder of protective colloid for use in the photographic element, gelatin is advantageously used, but other hydrophilic colloids may be used such as gelatin derivatives, colloidal albumin, gum arabic, colloidal hydrated silica, cellulose ester derivatives such as alkyl esters of carboxylated cellulose, hydroxy ethyl cellulose, carboxy methyl cellulose, synthetic resins, such as the amphoteric copolymers described in U.S. Pat. No. 2,949,442, polyvinyl alcohol, and others well known in the art. These binders may be used in admixture with dispersed (latex-type) vinyl polymers, such as those disclosed, for example, in U.S. Pat. Nos. 3,142,568, 3,193,386, 3,062,674, 3,220,844.

The silver halide emulsions can be sensitized with a chemical sensitizer as known in the art such as, for example, a noble metal sensitizer, a sulfur sensitizer, a selenium sensitizer and a reduction sensitizer.

The silver halide emulsions can be spectrally sensitized (ortho-, pan- or infrared-sensitized) with methine dyes such as those described in *The Cyanine Dyes and Related Compounds,* F. H. Hamer, John Wiley & Sons (1964). Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly useful dyes are those belonging to the class of cyanine dyes, merocyanine dyes and complex merocyanine dyes. Other dyes, which per se do not have any spectral sensitization activity, or certain other compounds, which do not substantially absorb visible radiation, can have a supersensitization effect when they are used in combination with said spectral sensitizing dyes. Among suitable sensitizers known in the art, heterocyclic mercapto compounds containing at least one electronegative substituent, nitrogen-containing heterocyclic ring-substituted aminostilbene compounds, aromatic organic acid/formaldehyde condensation products, cadmium salts and azaindene compounds are particularly useful.

The silver halide photographic elements according to the present invention may comprise compounds preventing the formation of fog or stabilizing the photographic characteristics during the production or storage of photographic elements or during the photographic treatment thereof, such as heterocyclic nitrogen-containing compounds, arylthiosulfinic acids and arylthiosulfonic acids.

The photographic elements according to this invention may comprise other additives such as desensitizers, brightening agents, couplers, hardening agents, coating agents, plasticizers, lubricants, matting agents, high-boiling organic solvents, development accelerating compounds, UV absorbers, antistatic agents, antistain agents, and the like as described, for example, in Research Disclosure Vol. 176, No. 17643, December 1979.

The photographic elements according to this invention can be used for any of general black and white photography, graphic arts, X-ray, print, microfilm, electron-ray record, infrared-ray record, color photography and the like.

Useful photographic elements according to this invention are silver chloride emulsion elements as conventionally employed in forming halftone, dot, and line images usually called "lith" elements. Said elements contain silver halide emulsions comprising preferably at least 50 mole % of silver chloride, more preferably at least 80 mole % of silver chloride, the balance, if any, being silver bromide. If desired, said silver halides can contain a small amount of silver iodide, in an amount that is usually less than about 5 mole %, preferably less than 1 mole %. The average grain size of silver halide used in lith emulsions is lower than about 0.7 micrometers, preferably lower than about 0.4 micrometers, more preferably lower than 0.2 micrometers. The lith elements can include a hydrazine compound to obtain high contrast images. Any known hydrazine compounds can be used, such as, for example, hydrazine compounds described in Research Disclosure 235, Item 23510, November 1983, *Development Nucleation by Hydrazine and Hydrazine Derivatives.* Other references to lith materials can be found in the same Research Disclosure.

Color photographic elements for use in the present invention comprise silver halide emulsion layers selectively sensitive to different portions of the visible and/or infrared spectrum and associated with yellow, magenta and cyan dye forming couplers which form (upon reaction with an oxidized primary amine type color developing agent) respectively yellow, magenta and cyan dye images. As yellow couplers, open chain ketomethylene compounds can be used, such as benzoylacetoanilide type yellow couplers and pyvaloylacetoanilide type yellow couplers. Two-equivalent type yellow couplers, in which a substituent capable of separating off at the time of coupling reaction attached to the carbon atom of the coupling position, can be used advantageously. As magenta couplers, pyrazolone type, pyrazolotriazole type, pyrazolinobenzimidazole type and indazolone type magenta couplers can be used. As cyan couplers, phenols and naphthols type cyan couplers can be used. Colored magenta couplers and colored cyan couplers can also be used advantageously, in addition to the above-mentioned couplers. For the purpose of improving sharpness and graininess of the image, the light-sensitive color materials used in this invention may additionally contain development inhibitor-releasing couplers or compounds.

Silver halide photographic elements for X-ray exposure to be used in the present invention comprise a transparent film base, such as a polyethyleneterephthalate film base, having on at least one of its sides, preferably on both of its sides, a silver halide emulsion layer. The silver halide emulsions coated on the sides may be the same or different and comprise silver halide emulsions commonly used in photographic elements, among which the silver bromide or silver bromoiodide emulsions being particularly useful for X-ray elements. The silver halide grains may have different shapes, for instance cubic, octahedral, spherical, tabular shapes, and may have epitaxial growth; they generally have mean grain sizes ranging from 0.2 to 3 micrometers, more preferably from 0.4 to 1.5 micrometers. Particularly useful in X-ray elements are high aspect ratio or intermediate aspect ratio tabular silver halide grains, as disclosed for example in U.S. Pat. Nos. 4,425,425 and 4,425,426, having an aspect ratio, that is the ratio of diameter to thickness, of greater that 5:1, preferably greater than 8:1. The silver halide emulsions are coated on the film base at a total silver coverage comprising in the range from about 2.5 to about 6 grams per square meter. Usually, the light-sensitive silver halide elements for X-ray recording are associated during X-ray exposure with intensifying screens as to be exposed to radiation emitted by said screens. The screens are made of relatively thick phosphor layers which transform X-rays into light radiation (e.g., visible light or infrared radiation). The screens absorb a portion of X-rays much larger than the light-sensitive element and are used to reduce radiation dose necessary to obtain a useful image. According to their chemical composition, the phosphors can emit radiation in the blue, green, red or infrared region of the electromagnetic spectrum and the silver halide emulsions are sensitized to the wavelength region of the radiation emitted by the screens. Sensitization is performed by using spectral sensitizing dyes as known in the art. Particularly useful phosphors are the rare earth oxysulfides doped to control the wavelength of the emitted light and their own efficiency. Preferably are lanthanum, gadolinium and lutetium oxysulfides doped with trivalent terbium as described in U.S. Pat. No. 3,752,704. Among these phosphors, the preferred ones are gadolinium oxysulfides wherein from about 0.005% to about 8% by weight of the gadolinium ions are substituted with trivalent terbium ions, which upon excitation by UV radiation, X-rays, cathodic rays emit in the blue-green region of the spectrum with a main emission line at about 544 nm. The silver halide emulsions are spectrally sensitized to the spectral region of the light emitted by the screens, preferably to a spectral region of an interval comprised within 25 nm from the wavelength maximum emission of the screen, more preferably within 15 nm, and most preferably within 10 nm.

The light-sensitive silver halide photographic elements according to this invention can be processed after exposure to form a visible image according to processes which are generally employed for the light-sensitive elements for general black and white photography, X-ray, microfilm, lith film, print or color photography. In particular, the basic treatments steps of black and white photography include development with a black and white developing solution and fixation, and the basic treatment steps of color photography include color development, bleach and fixation. Processing formulations and techniques are described, for example, in *Photographic Processing Chemistry*, L. F. Mason, Focal Press (1966), *Processing Chemicals and Formulas*, Publication J-1, Eastman Kodak Company (1973), *Photo-Lab Index*, Morgan and Morgan, Dobbs Ferry (1977), *Neblette's Handbook of Photography and Reprography—Materials, Processes and Systems*, VanNostrand Reinhold, 7th Ed. (1977), and *Research Disclosure*, Item 17643 (December 1978).

Objects and advantages of this invention are further illustrated by the following examples, but the particular materials and amounts thereof recited in these examples, as well as other conditions and details, should not be construed to unduly limit this invention.

In the Examples below, all percents are by weight unless otherwise indicated.

I. PREPARATION OF VANADIUM OXIDE

Vanadium oxide colloidal dispersion was prepared by adding vanadium triisobutoxide ($VO(O\text{-}iBu)_3$) (15.8 g, 0.055 moles, Akzo Chemicals, Inc., Chicago, Ill.) to a rapidly stirring solution of hydrogen peroxide (1.56 g of a 305 aqueous solution, 0.0138 moles, Mallinckrodt, Paris, Ky.) in deionized water (232.8 g) at room temperature giving a solution with vanadium concentration equal to .22 moles/kg (2.0% $V_2O_5$). Upon addition of the vanadium isobutoxide, the mixture became dark brown and gelled within five minutes. With continous stirring, the dark brown gel broke up giving an inhomogeneous, viscous dark brown solution which was homogeneous in about 45 minutes. The sample was allowed to stir for 1.5 hours at room temperature. It was then transferred to a polyethylene bottle and aged in a constant temperature bath at 50° C. for 6 days to give a dark brown thixotropic colloidal dispersion.

The concentration of V(+4) in the gel was determined by titration with potassium permanganate to be 0.072 moles/kg. This corresponded to a mole fraction of V(+4) [i.e., V(+4)/total vanadium] of 0.33.

The colloidal dispersion was then further mixed with deionized water to form desired concentrations before use in coating formulations.

II. PREPARATION OF SULFOPOLYESTER

Synthesis of Sulfopolyester (Polymer A)

A one gallon polyester kettle was charged with 126 g (6.2 mole %) dimethyl 5-sodiosulfoisophthalate, 625.5 g (46.8 mole %) dimethyl terephthalate, 628.3 g (47.0 mole %) dimethyl isophthalate, 854.4 g (200 mole % glycol excess) ethylene glycol, 365.2 g (10 mole %, 22 weight % in final polyester) PCP-0200 TM polycaprolactone diol (Union Carbide, Danbury, CT), 0.7 g antimony oxide, and 2.5 g sodium acetate. The mixture was heated with stirring to 180° C. at 138 kPa (20 psi) under nitrogen, at which time 0.7 g of zinc acetate was added. Methanol evolution was observed. The temperature was increased to 220° C. and held for 1 hour. The pressure was then reduced, vacuum applied (0.2 torr), and the temperature increased to 260° C. The viscosity of the material increased over a period of 30 minutes, after which time a high molecular weight, clear, viscous sulfopolyester was drained. This sulfopolyester was found by DSC to have a $T_g$ of 41.9° C. The theoretical sulfonate equivalent weight was 3954 g polymer per mole of sulfonate. 500 g of the polymer were dissolved in a mixture of 2000 g water and 450 g isopropanol at 80° C. The temperature was then raised to 95° C. in order to remove the isopropanol (and a portion of water), yielding a 21% solids aqueous dispersion.

Synthesis of Sulfopolyester (Polymer B)

A 1000 ml three-necked round bottom flask equipped with a sealed stirrer, thermometer, reflux condenser and means for reducing pressure was charged with 134.03 g dimethyl terephthalate (65 mole percent)
47.16 g dimethyl sodium sulfoisophthalate (15 mole percent)
36.99 g dimethyl adipate (20 mole percent)
131.79 g ethylene glycol (100 mole percent)
0.11 g antimony trioxide, and
0.94 g sodium acetate.

The mixture was stirred and heated to 155° C. and maintained at 155° C. to 180° C. for about 2 hours while methanol distilled. When the temperature reached 180° C., 0.5 g zinc acetate (an esterification catalyst) was added. The temperature was slowly increased to 230° C. over a period of 5 hours, during which time methanol evolution was completed. The pressure in the flask was reduced to 0.5 Torr or lower, whereupon ethylene glycol distilled, about 60 g being collected. The temperature was then increased to 250° C. where it was held for 1.5 hours after which the system was brought to atmospheric pressure with dry nitrogen and the reaction product was drained from the flask into a polytetrafluoroethylene pan and allowed to cool. The resulting polyester had a $T_g$ by DSC of 45° C. and a (melting point) $T_m$ of 170° C. The sulfopolyester had a theoretical sulfonate equivalent weight of 1350, and was soluble in hot (80° C.) water.

III. PREPARATION OF COATING MIXTURES

General Procedure:

The vanadium oxide colloidal dispersion was diluted to desired concentration by mixing with deionized water. This solution was mixed with an aqueous dispersion of the sulfopolyester and a small amount of a surfactant. Addition of surfactant was preferred to improve the wetting properties of the coating. The mixture was coated with double roller coating onto a film substrate such as polyethyleneterephthalate or cellulose triacetate in order to perform static decay and surface resistivity measurements. It was found possible to coat the antistatic composition onto the film substrate as such without employing film treatments (e.g., flame treatment, corona treatment, plasma treatment) or additional layers (e.g., primers, subbings).

The coated article was dried at 60° C. for 2 minutes. The antistatic properties of the coated film were measured by determining the surface resistivity of each coated sample. Surface resistivity measurements were made using the following procedure: samples of each film were kept in a cell at 21° C. and 25% R.H. for 24 hours and the electrical resistivity was measured by means of a Hewlett-Packard High resistance Meter model 4329A. Values of resistivity of less than $5\times10^{11}$ are optimum. Values up to $1\times10^{12}$ can be useful. The following examples also report four adhesion values: the first is the dry adhesion value and refers to the adhesion of the silver halide emulsion layers and of the auxiliary gelatin layers to the antistatic layer prior to the photographic processing; the second and the third adhesion values are the wet adhesion values and refer to the adhesion of the above layers to the antistatic layer during the photographic processing (developer and fixer); the fourth adhesion value is the dry adhesion value and refers to the adhesion of the above layers to the antistatic layer after photographic processing. In particular, the dry adhesion was measured by tearing samples of the coated film, applying a 3M Scotch® brand 5959 Pressure sensitive Tape along the tear line of the film and separating rapidly the tape from the film: the layer adhesion was evaluated according a scholastic method giving a value 0 when the whole layer was removed from the base and a value of 10 when no part thereof was removed from the base and intermediate values for intermediate situations. The wet adhesion was measured by drawing some lines with a pencil point to form an asterisk on the film just taken out from the processing bath and by rubbing on the lines with a finger. Also in this case, the adhesion of the layers was measured according to a scholastic method by giving a value of 0 when the layers were totally removed from the base, a value of 10 when no portion thereof was removed and intermediate values for intermediate cases.

EXAMPLE 1

An aqueous antistatic formulation comprising 0.025 weight percent vanadium oxide prepared as described above, 0.025 weight percent of terpolymer latex of vinylidene chloride, ethyl acrylate and itaconic acid, 0.02 weight percent Triton X-100 (surfactant product of Rohm and Haas Corp., Philadelphia, Pa.) was coated with double roller coating onto an untreated polyethyleneterephthalate film base at a coverage of 6 ml/m$^2$ and dried at 60° C. for 2 minutes to obtain an antistatic film (Film 1 ).

An aqueous formulation containing 3 weight percent of terpolymer latex of vinylidene chloride, ethyl acrylate and itaconic acid was coated over the antistatic layer of Film 1 and dried at 60° C. for 2 minutes to give a protective layer dry weight of 0.3 g/m$^2$ (Film 2).

An aqueous antistatic formulation comprising 0.025 weight percent vanadium oxide prepared as described above, 1 weight percent of terpolymer latex of vinylidene chloride, ethyl acrylate and itaconic acid, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 3).

An aqueous antistatic formulation comprising 0.025 weight percent vanadium oxide prepared as described above, 0.025 weight percent of the sulfopolyester Polymer A described above, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 4).

An aqueous antistatic formulation comprising 0.025 weight percent vanadium oxide prepared as described above, 1 weight percent of the sulfopolyester Polymer A described above, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 5).

An aqueous formulation containing I weight percent of the sulfopolyester was coated over the antistatic layer of Film 6 and dried at 60° C. for 2 minutes to give a protective layer dry weight of 0.1 g/m$^2$ (Film 6).

Samples of the films were evaluated for adhesion of the antistatic layer to the film base and for permanence of the antistatic properties after processing in conventional film processing solutions. Adhesion was measured as described before. Permanence of antistatic properties was checked by measuring the surface resistivity (at 25% relative humidity) before and after treatment in the standard type C41 process described in British Journal of Photography Annual, 1977, pp. 201–205 for processing of silver halide color photographic materials.

The results obtained are reported in Table 1 below:

TABLE 1

| Film | Surface resistivity (ohms/square) | |
|---|---|---|
| | Before Processing | After Processing |
| 1 (comp) | $2 \times 10^8$ | $1 \times 10^{11}$ |
| 2 (comp) | $2 \times 10^9$ | $1 \times 10^{12}$ |
| 3 (comp) | $3 \times 10^8$ | $5 \times 10^{11}$ |
| 4 (comp) | $7 \times 10^8$ | $7 \times 10^{11}$ |
| 5 (inv) | $3 \times 10^9$ | $3 \times 10^9$ |
| 6 (comp) | $1 \times 10^{11}$ | $1 \times 10^{13}$ |

The data of Table 1 show that the film of the present invention, having a single antistatic layer coated onto the polyester film base, provides excellent antistatic properties and little or no change in resistivity after processing. Adhesion of the antistatic coating to the film base was good for all the films. The same results were obtained using, instead of sulfopolyester Polymer A, the sulfopolyester Polymer B, the AQ55 TM sulfopolyester dispersion (product of Eastman Kodak Co., Kingsport, Tenn.) and the AQ29 TM sulfopolyester dispersion (product of Eastman Kodak Co., Kingsport, Tenn.).

EXAMPLE 2

An aqueous antistatic formulation comprising 0.025 weight percent vanadium oxide prepared as described above, 0.025 weight percent of terpolymer latex of vinylidene chloride, ethyl acrylate and itaconic acid, 0.02 weight percent Triton X-100 (surfactant product of Rohm and Haas Corp., Philadelphia, Pa.) was coated with double roller coating onto an untreated cellulose triacetate film base at a coverage of 6 ml/m$^2$ and dried at 60° C. for 2 minutes to obtain an antistatic film (Film 1).

An aqueous antistatic formulation comprising 0.025 weight percent vanadium oxide prepared as described above, 1 weight percent of terpolymer latex of vinylidene chloride, ethyl acrylate and itaconic acid, 0.02 weight percent Triton X-100, was coated with double roller coating onto an untreated cellulose triacetate film base at a coverage of 6 ml/m$^2$ and dried at 60° C. for 2 minutes to obtain an antistatic film (Film 2).

An aqueous antistatic formulation comprising 0.025 weight percent vanadium oxide prepared as described above, 0.025 weight percent of the sulfopolyester Polymer A described above, 0.02 weight percent Triton X-100, was coated with double roller coating onto an untreated cellulose triacetate film base at a coverage of 6 ml/m$^2$ and dried at 60° C. for 2 minutes to obtain an antistatic film (Film 3).

An aqueous antistatic formulation comprising 0.025 weight percent vanadium oxide prepared as described above, I weight percent of the sulfopolyester Polymer A described above, 0.02 weight percent Triton X-100, was coated with double roller coating onto an untreated cellulose triacetate film base at a coverage of 6 ml/m$^2$ and dried at 60° C. for 2 minutes to obtain an antistatic film (Film 4).

Samples of the films were evaluated for adhesion of the antistatic layer to the film base and for permanence of the antistatic properties after processing in conventional film processing solutions as described in Example 1.

The results obtained are reported in Table 2 below:

TABLE 2

| Film | Surface resistivity (ohms/square) Before Processing | After Processing |
|---|---|---|
| 1 (comp) | $2 \times 10^8$ | $1 \times 10^{13}$ |
| 2 (comp) | $2 \times 10^8$ | $1 \times 10^{13}$ |
| 3 (comp) | $4 \times 10^8$ | $1 \times 10^{13}$ |
| 4 (inv) | $4 \times 10^9$ | $8 \times 10^9$ |

The data of Table 1 show that the film of the present invention provides excellent antistatic properties and comparatively no significant change in resistivity after processing. Adhesion of the antistatic coating to the film base was good for all the films except for film 2 whose adhesion was bad. The same results were obtained using, instead of sulfopolyester Polymer A, the sulfopolyester Polymer B, the AQ55 TM sulfopolyester dispersion (product of Eastman Kodak Co., Kingsport, Tenn.) and the AQ29 TM sulfopolyester dispersion (product of Eastman Kodak Co., Kingsport, Tenn.).

EXAMPLE 3

Film A was prepared by coating a cellulose triacetate support base, subbed with gelatin, with the following layers in the following order:

(a) a layer of black colloidal silver dispersed in gelatin having a silver coverage of 0.27 g/m$^2$ and a gelatin coverage of 1.33 g/m$^2$;

(b) an intermediate layer containing 0.97 g/m$^2$ of gelatin;

(c) a layer of low sensitivity red-sensitive silver halide emulsion comprising a sulfur and gold sensitized low-sensitivity silver bromoiodide emulsion (having 2.5% silver iodide moles and a mean grain size of 0.18 μm) at a total silver coverage of 0.71 g/m$^2$ and a gelatin coverage of 0.94 g/m$^2$, containing the cyan-dye forming coupler C-1 at a coverage of 0.354 g/m$^2$, the cyan-dye forming DIR coupler C-2 at a coverage of 0.024 g/m$^2$ and the magenta colored cyan-dye forming coupler C-3 at a coverage of 0.043 g/m$^2$, dispersed in a mixture of tricresylphosphate and butylacetanilide;

(d) layer of medium-sensitivity red-sensitive silver halide emulsion comprising a sulfur and gold sensitized silver chloro-bromo-iodide emulsion (having 7% silver iodide moles and 5% silver chloride moles and a mean grain size of 0.45 μm) at a silver coverage of 0.84 g/m$^2$ and a gelatin coverage of 0.83 g/m$^2$ containing the cyan-dye forming coupler C-1 at a coverage of 0.333 g/m$^2$, the cyan-dye forming DIR coupler C-2 at a coverage of 0.022 g/m$^2$ and the magenta colored cyan-dye forming coupler C-3 at a coverage of 0.052 g/m$^2$, dispersed in a mixture of tricresylphosphate and butylacetanilide;

(e) a layer of high-sensitivity red-sensitive silver halide emulsion comprising a sulfur and gold sensitized silver bromo-iodide emulsion (having 12% silver iodide moles and a mean grain size of 0.11 μm) at a silver coverage of 1.54 g/m$^2$ and a gelatin coverage of 1.08 g/m$^2$, containing two cyan-dye forming couplers, the coupler C-1 (containing a cyano group) at a coverage of 0.224 g/m$^2$ and the coupler C-4 at a coverage of 0.032 g/m$^2$, and the cyan-dye forming DIR coupler C-2 at a coverage of 0.018 g/m$^2$, dispersed in a mixture of tricresylphosphate and butylacetanilide;

(f) an intermediate layer containing 1.11 g/m$^2$ of gelatin, comprising the 2-chloro-4,6-dihydroxy-1,3,5-triazine gelatin hardener H-1 at a coverage of 0,183 g/m$^2$;

(g) a layer of low sensitivity green sensitive silver halide emulsion comprising a blend of 63% w/w of the low-sensitivity emulsion of layer c) and 37% w/w of the medium-sensitivity emulsion of layer (d) at a silver coverage of 1.44 g/m$^2$ and a gelatin coverage of 1.54 g/m$^2$, containing the magenta-dye forming coupler M-1, at a coverage of 0.537 g/m$^2$, the magenta dye forming DIR coupler M-2 at a coverage of 0.017 g/m$^2$, and the yellow colored magenta dye forming coupler M-3 at a coverage of 0.079 g/m$^2$, the yellow coloured magenta dye forming coupler M-4 at a coverage of 0.157 g/m$^2$, and dispersed in tricresylphosphate;

(h) a layer of high-sensitivity green sensitive silver halide emulsion comprising the emulsion of layer (e) at a silver coverage of 1.60 g/m$^2$ and a gelatin coverage of 1.03 g/m$^2$ containing the magenta dye forming coupler M-1, at a coverage of 0.498 g/m$^2$, the magenta dye forming DIR coupler M-2 at a coverage of 0.016 g/m$^2$, the yellow coloured magenta dye forming coupler M-3 at a coverage of 0.021 g/m$^2$, and the yellow colored magenta dye forming coupler M-4 at a coverage of 0.043 g/m$^2$, dispersed in tricresylphosphate;

(i) an intermediate layer containing 1.06 g/m$^2$ of gelatin;

(j) a yellow filter layer containing 1.18 g/m$^2$ of gelatin, comprising the 2-chloro-4,6-dihydroxy-1,3,5-triazine gelatin hardener H-1 at a coverage of 0.148 g/m$^2$;

(k) a layer of low-sensitivity blue-sensitive silver halide emulsion comprising a blend of 60% w/w of the low- sensitivity emulsion of layer c) and 40% w/w of the medium-sensitivity emulsion of layer (d) at a silver coverage of 0.53 g/m$^2$ and a gelatin coverage of 1.65 g/m$^2$ and the yellow dye forming coupler Y-1 at a coverage of 1.042 g/m$^2$ and the yellow dye forming DIR coupler Y-2 at a coverage of 0.028 g/m$^2$ dispersed in a mixture of diethyllaurate and dibutylphthalate;

(l) a layer of high-sensitivity blue sensitive silver halide emulsion comprising the emulsion of layer (e) at a silver coverage of 0.90 g/m$^2$ and a gelatin coverage of 1.24 g/m$^2$, containing the yellow dye-forming coupler Y-1 at a coverage of 0.791 g/m$^2$ and the yellow dye forming DIR coupler Y-2 at a coverage of 0.021 g/m$^2$ dispersed in a mixture of diethyllaurate and dibutylphthalate;

(m) a protective layer of 1.28 g/m$^2$ of gelatin, comprising the UV absorber UV-1 (containing two cyano groups) at a coverage of 0.1 g/m$^2$; and (n) a top coat layer of 0.73 g/m$^2$ of gelatin containing 0.273 g/m$^2$ of polymethylmethacrylate matting agent MA-1 in form of beads having an average diameter of 2.5 micrometers, and the 2-chloro-4,6-dihydroxy-1,3,5-triazine hardener H-1 at a coverage of 0.468 g/m$^2$.

The total silver coverage of the silver halide emulsion layers was 6.99 g/m$^2$.

On the side of the cellulose triacetate film base opposite the silver halide emulsion and auxiliary layers was coated a backing antistatic layer comprising the sodium salt of polystyrene sulfonic acid and cellulose acetate at a total coverage of 0.4 g/m$^2$.

Film B was prepared by coating the cellulose triacetate support base, subbed with gelatin, with the same silver halide emulsion and auxiliary layers of Film A. On the side of the cellulose triacetate film base opposite the silver halide emulsion and auxiliary layers was coated an aqueous antistatic formulation comprising 0.025 weight percent vanadium oxide prepared as described above, 1 weight percent of the sulfopolyester Polymer A described above, 0.02 weight percent 10% Triton X-100, with double roller coating at a coverage of 6 ml/m$^2$ and dried at 60° C. for 2 minutes to obtain a backing antistatic layer.

Samples of the films A and B, together with commercial samples of Kodacolor Gold ISO 100 and Fujicolor SHR ISO 100 color print films, were evaluated for permanence of the antistatic properties after processing in conventional film processing solutions as described in Example 1.

The results obtained are reported in Table 3 below:

TABLE 3

| Film | Surface resistivity (ohms/square) Before Processing | After Processing |
|---|---|---|
| A (comp) | $7 \times 10^9$ | $4 \times 10^{14}$ |
| B (inv) | $4 \times 10^9$ | $8 \times 10^9$ |
| Kodacolor Gold | $3 \times 10^9$ | $1 \times 10^{14}$ |
| Fujicolor SHR | $4 \times 10^9$ | $7 \times 10^{15}$ |

The data of Table 3 show that the film of the present invention provides excellent antistatic properties and comparatively no significant change of resistivity after processing.

Formulas of compounds used in Example 3 will be presented below.

Cyan dye forming coupler C-1:

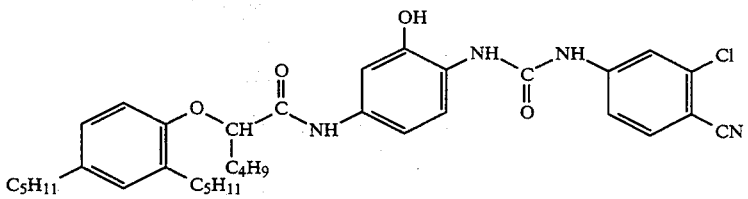

Cyan dye forming coupler C-2:

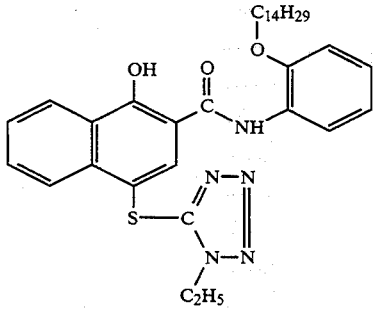

Magenta colored cyan dye forming coupler C-3:

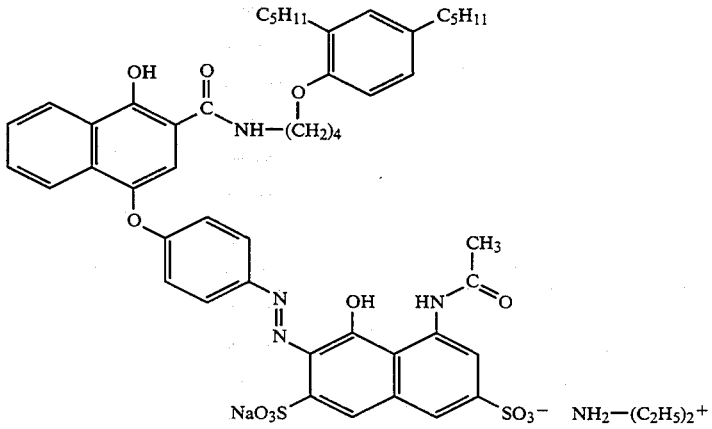

Cyan dye forming coupler C-4:

-continued
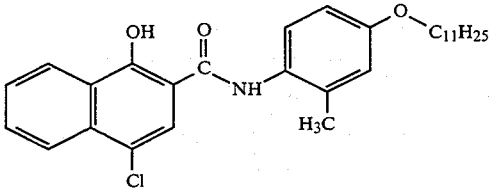
Magenta dye forming coupler M-1:
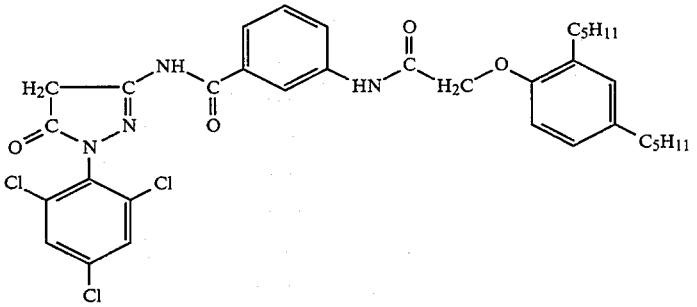
Magenta dye forming DIR coupler M-2:
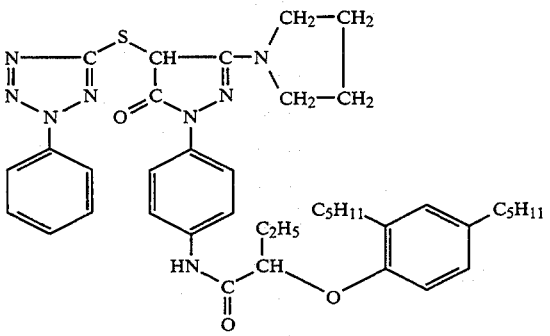
Yellow colored magenta dye forming coupler M-3:
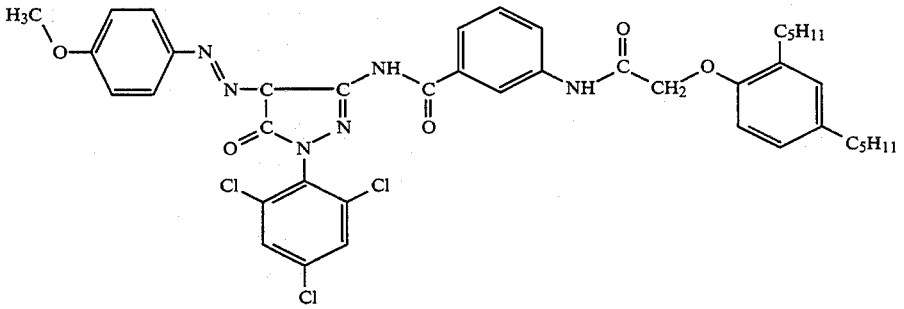
Yellow dye forming coupler Y-1:
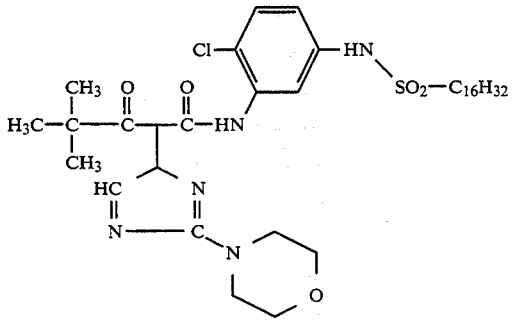
Yellow dye forming DIR coupler Y-2:

-continued

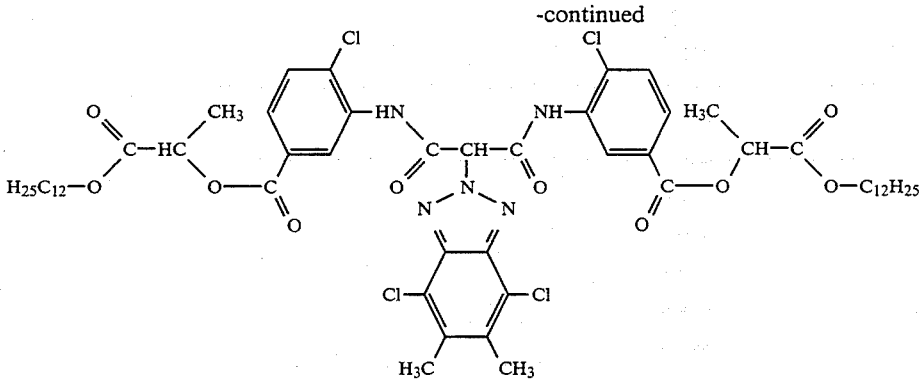

UV absorber UV-1:

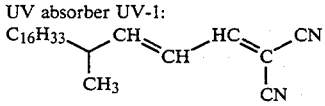

Matting agent MA-1:

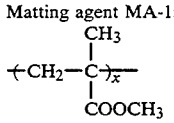

Gelatin hardener H-1:

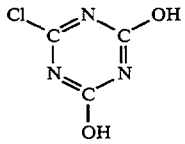

EXAMPLE 4

An aqueous antistatic formulation comprising 0.025 weight percent vanadium oxide prepared as described above, 1 weight percent of the sulfopolyester Polymer A described above, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 1).

An aqueous antistatic formulation comprising 0.025 weight percent vanadium oxide prepared as described above, 0.7 weight percent of the sulfopolyester Polymer A described above, 0.3 weight percent of gamma-glycydoxypropyltrimethoxysilane, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 2).

The antistatic layer of Films 1 and 2 was overcoated with a conventional gelatin antihalation layer containing antihalation dyes, a surfactant and a hardener and with a gelatin protective layer containing a matting agent, a surfactant and a hardener (Films 3 and 4, respectively). The two layers were coated at approximately pH 6. The total gelatin g/m$^2$ was 4.5 and the thickness was approximately 4.5 micrometers.

The following Table 4 reports the values of surface resistivity, and dry and wet adhesion (between antihalation layer and antistatic layer).

TABLE 4

| | Film 1 | Film 2 | Film 3 | Film 4 |
|---|---|---|---|---|
| Surface Resist. (Ohms/sq) | $2 \times 10^9$ | $5 \times 10^9$ | $3 \times 10^{10}$ | $5 \times 10^{10}$ |

TABLE 4-continued

| | Film 1 | Film 2 | Film 3 | Film 4 |
|---|---|---|---|---|
| Adhesion (3M RDC5 Proc.) | | | | |
| before processing | — | — | 5 | 8 |
| in developer | — | — | 0 | 10 |
| in fixer | — | — | 0 | 10 |
| after processing | — | — | — | 10 |

Film 4, containing the antistatic layer according to this invention overcoated with the gelatin antihalation layer, shows good antistatic properties and good dry and wet adhesion.

EXAMPLE 5

An aqueous antistatic formulation comprising 0.025 weight percent vanadium oxide prepared as described above, 0.73 weight percent of the sulfopolyester Polymer A described above, 0.3 weight percent of gamma-glycydoxypropyltdmethoxysilane, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 1).

An aqueous antistatic formulation comprising 0.0375 weight percent vanadium oxide prepared as described above, I weight percent of the sulfopolyester Polymer A described above, 0.26 weight percent of gamma-glycydoxypropyltrimethoxysilane, 0.02 weight percent Triton X-100, was coated with double roller coating onto an untreated polyethyleneterephthalate film base at a coverage of 6 ml/m$^2$ and dried at 60° C. for 2 minutes to obtain an antistatic film (Film 2).

The antistatic layer of Films I and 2 was overcoated with a light-sensitive emulsion comprising a gelatino-silver bromide emulsion chemically sensitized with gold and sulfur and optically sensitized to green light with a cyanine dye. The emulsion was coated at a silver coverage of 2 g/m$^2$ and gelatin coverage of 1.6 g/m$^2$ per side. A gelatin protective layer containing 1.1 g/m$^2$ of gelatin per side and a hardener was coated onto each emulsion layer (Films 3 and 4, respectively).

An antistatic film base was prepared as described in Example 3 of U.S. Pat. No. 4,424,273. The antistatic film base comprised a polyethyleneterephthalate film base coated on both sides with a primer comprising the terpolymer vinylidene chloride-itaconic acid-methylacrylate and a subbing comprising the conductive polymer obtained by reaction of polyvinyl alcohol and benzaldehyde-2,4-disulfonic acid. The antistatic layer was then overcoated with the emulsion layer and the protective layer of Films 3 and 4 (Film 5).

The following Table 5 reports the results obtained with Films 3 to 5.

TABLE 5

| | Film 3 | Film 4 | Film 5 |
|---|---|---|---|
| Surface Resist. (Ohms/sq) | $2 \times 10^9$ | $1 \times 10^9$ | $1 \times 10^{13}$ |
| Adhesion (3M XP515 Process) | | | |
| before processing | 10 | 10 | 10 |
| in developer | 10 | 10 | 10 |
| in fixer | 10 | 10 | 10 |
| after processing | 10 | 10 | 10 |

The data show the good values of surface resistivity and adhesion (between the silver halide emulsion layer and the antistatic layer) of Films 3 and 4 made according to this invention.

EXAMPLE 6

An aqueous antistatic formulation comprising 0.025 weight percent vanadium oxide prepared as described above, 0.7 weight percent of the sulfopolyester Polymer A described above, 0.3 weight percent of gamma-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 1).

An aqueous antistatic formulation comprising 0.025 weight percent vanadium oxide prepared as described above, 0.8 weight percent of the sulfopolyester Polymer A described above, 0.2 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 2).

An aqueous antistatic formulation comprising 0.025 weight percent vanadium oxide prepared as described above, 0.9 weight percent of the sulfopolyester Polymer A described above, 0.1 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 3).

An aqueous antistatic formulation comprising 0.025 weight percent vanadium oxide prepared as described above, 1.0 weight percent of the sulfopolyester Polymer A described above, 0.5 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 4).

An aqueous antistatic formulation comprising 0.025 weight percent vanadium oxide prepared as described above, 1.2 weight percent of the sulfopolyester Polymer A described above, 0.3 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 5).

An aqueous antistatic formulation comprising 0.025 weight percent vanadium oxide prepared as described above, 1.35 weight percent of the sulfopolyester Polymer A described above, 0.15 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 6).

An aqueous antistatic formulation comprising 0.025 weight percent vanadium oxide prepared as described above, 1.4 weight percent of the sulfopolyester Polymer A described above, 0.6 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 7).

An aqueous antistatic formulation comprising 0.025 weight percent vanadium oxide prepared as described above, 1.6 weight percent of the sulfopolyester Polymer A described above, 0.4 weight percent of γ-glycydoxypropyltrimethoxysilane, 0.02 weight percent Triton X-100, was coated with double roller coating onto an untreated polyethylene terephthalate film base at a coverage of 6 ml/m$^2$ and dried at 60° C. for 2 minutes to obtain an antistatic film (Film 8).

The antistatic layer of each of Films 1 to 8 was overcoated with a conventional gelatin antihalation layer containing antihalation dyes, a surfactant and a hardener and with a gelatin protective layer containing a matting agent, a surfactant and a hardener (Films 9 to 16, respectively). The two layers were coated at approximately pH 6. The total gelatin g/m$^2$ was 4.5 and the thickness was approximately 4.5 micrometers.

The following Table 6 reports the values of surface resistivity measured at 25% R.H. and 21° C. before photographic processing and after photographic processing respectively in 3M RCD5 Process (processing chemistry for Graphic Arts films) and 3M XP515 Process (processing chemistry for X-ray films).

TABLE 6

| | Surface Resistivity (Ohms/sq) | | |
|---|---|---|---|
| | | After Processing in | |
| Film | Before Process. | 3M RCD5 Proc. | 3M XP515 Proc. |
| 1 | $1 \times 10^9$ | $5 \times 10^{14}$ | $1 \times 10^{11}$ |
| 2 | $7 \times 10^8$ | $3 \times 10^{11}$ | $2 \times 10^9$ |
| 3 | $6 \times 10^8$ | $3 \times 10^{10}$ | $3 \times 10^9$ |
| 4 | $8 \times 10^8$ | $3 \times 10^{10}$ | $1 \times 10^9$ |
| 5 | $1 \times 10^9$ | $3 \times 10^9$ | $1 \times 10^9$ |
| 6 | $7 \times 10^8$ | $3 \times 10^9$ | $1 \times 10^9$ |
| 7 | $7 \times 10^8$ | $5 \times 10^9$ | $1 \times 10^9$ |
| 8 | $7 \times 10^8$ | $3 \times 10^9$ | $1 \times 10^9$ |
| 9 | $2 \times 10^{10}$ | $8 \times 10^{13}$ | $8 \times 10^{10}$ |
| 10 | $1 \times 10^{10}$ | $8 \times 10^{13}$ | $8 \times 10^{10}$ |

TABLE 6-continued

| Film | Surface Resistivity (Ohms/sq) Before Process. | After Processing in 3M RCD5 Proc. | 3M XP515 Proc. |
|---|---|---|---|
| 11 | $1 \times 10^{10}$ | $7 \times 10^{11}$ | $7 \times 10^{10}$ |
| 12 | $1 \times 10^{10}$ | $3 \times 10^{10}$ | $3 \times 10^{10}$ |
| 13 | $2 \times 10^{10}$ | $3 \times 10^{10}$ | $3 \times 10^{10}$ |
| 14 | $2 \times 10^{10}$ | $2 \times 10^{10}$ | $3 \times 10^{10}$ |
| 15 | $2 \times 10^{10}$ | $1 \times 10^{10}$ | $3 \times 10^{10}$ |
| 16 | $3 \times 10^{10}$ | $1 \times 10^{10}$ | $1 \times 10^{10}$ |

The data show the good values of surface resitivity for films 1 to 16 before processing, permanence of antistatic properties after radiographic processing, and permanence of antistatic properties after lithographic processing by appropriate selection of vanadium oxide to total solids ratio or percent of adhesion promoter.

We claim:

1. A light-sensitive photographic element comprising a polymeric film base, at least one silver halide emulsion layer, and an antistatic layer comprising a colloidal vanadium oxide, an adhesion promoting compound, and a sulfopolyester adhered to at least one side of said polymeric film base, wherein the weight ratio of vanadium oxide to sulfopolyester is no greater than 1:20.

2. The light-sensitive photographic element of claim 1 wherein the polymeric film base comprises a polyester film base or a cellulose ester film base.

3. The light-sensitive photographic element of claim 1 wherein the sulfopolyester comprises units represented by the formula:

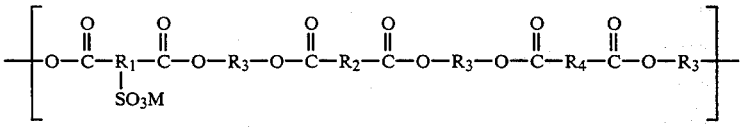

where

M represents an alkali metal cation or ammonium cation, $R_1$ represents a sulfosubstituted arylene or aliphatic group, $R_2$ represents an arylene group, $R_3$ represents an alkylene group, $R_4$ represents an alkylene group or cycloalkylene group.

4. The light-sensitive photographic element of claim 1 wherein the weight ratio of vanadium oxide to sulfopolyester ranges from 1:20 to 1:150.

5. The light-sensitive photographic element of claim 1 wherein the antistatic layer has a coating weight in the range of 10 mg/m$^2$ to 1 g/m$^2$.

6. The light-sensitive photographic element of claim 1 wherein the silver halide emulsion layer is on the same side of said film base as said antistatic layer.

7. The light-sensitive photographic element of claim 1 wherein the silver halide emulsion layer is on the opposite side of said film base as said antistatic layer.

8. The light-sensitive photographic element of claim 7 wherein an auxiliary gelatin layer is adhered to said antistatic layer.

9. The light-sensitive photographic element of claim 1 wherein said antistatic layer is on only one side of the film base.

10. The light-sensitive photographic element of claim 9 having a silver halide emulsion layer adhered to at least one side of said film base.

11. The light-sensitive photographic element of claim 9 wherein said silver halide emulsion layer is on the same side of said film base as said antistatic layer.

12. The light-sensitive photographic element of claim 9 wherein the silver halide emulsion layer is on the opposite side of said film base as said antistatic layer.

13. The light-sensitive photographic element of claim 12 wherein an auxiliary gelatin layer is adhered to said antistatic layer.

14. The light-sensitive photographic element of claim 1 wherein said adhesion promoting compound is an epoxy-silane compound.

15. The light-sensitive photographic element of claim 14 wherein said epoxy-silane compound is represented by the formulae

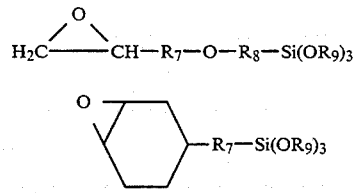

wherein:

$R_7$ and $R_8$ are independently alkylene groups of 1 to 4 carbon atoms, and $R_9$ is hydrogen or an alkyl group of 1 to 10 carbon atoms.

16. The light-sensitive photographic element of claim 14 wherein said epoxy-silane compound is gamma-glycydoxypropyltrimethoxysilane.

17. The light-sensitive photographic element of claim 14 wherein said epoxy-silane compound is beta-(3,4-epoxycyclohexyl)-ethyltrimethoxysilane.

18. The light-sensitive photographic element of claim 14 wherein the weight ratio of epoxy-silane to sulfopolyester is in the range of 0.1 to 0.6.

19. The light-sensitive photographic element of claim 14 wherein said epoxy-silane compound is partially or fully hydrolized.

20. The light-sensitive photographic element of claim 14 wherein said epoxy-silane compound is a siloxane polymer or oligomer.

21. The light-sensitive photographic element of claim 14 wherein said epoxy-silane compound is represented by the formulae

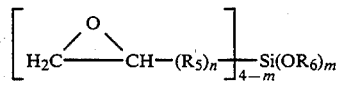

-continued

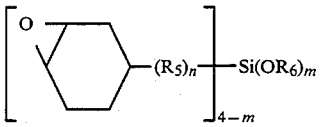

wherein:

$R_5$ is a divalent hydrocarbon radical of less than 20 carbon atoms, $R_6$ is hydrogen, an aliphatic hydrocarbon radical of less than 10 carbon atoms or an acyl radical of less than 10 carbon atoms, n is 0 or 1, and m is an integer of 1 to 3.

22. The light-sensitive photographic element of claim 1 wherein said adhesion promoter is a non-silane epoxy oligomer or polymer compound.

23. A light-sensitive photographic element comprising a polymeric film base, at least one silver halide emulsion layer, and, as a backing layer on the opposite side of the base from the silver halide emulsion layer or between the base and the emulsion layer and adhered directly to the silver halide emulsion layer, a single antistatic layer comprising a colloidal vanadium oxide, an epoxysilane adhesion promoting compound, and a sulfopolyester, wherein the weight ratio of vanadium oxide to sulfopolyester is no greater than 1:20.

24. A light-sensitive photographic element comprising a polymeric film base, at least one silver halide emulsion layer, and an antistatic layer comprising a colloidal vanadium oxide and a sulfopolyester adhered to at least one side of said polymeric film base, wherein the weight ratio of vanadium oxide to sulfopolyester is no greater than 1:20.

25. The light-sensitive photographic element of claim 24 wherein the polymeric film base comprises a polyester film base or a cellulose ester film base.

26. The light-sensitive photographic element of claim wherein the sulfopolyester comprises units represented by the formula:

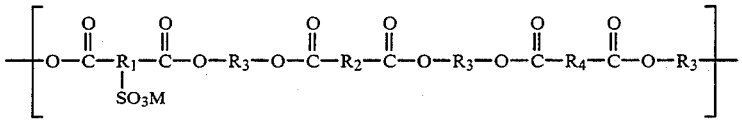

where

M represents an alkali metal cation or ammonium cation, $R_1$ represents a sulfosubstituted arylene or aliphatic group, $R_2$ represents an arylene group, $R_3$ represents an alkylene group, $R_4$ represents an alkylene group or cycloalkylene group.

27. The light-sensitive photographic element of claim 24 wherein the weight ratio of vanadium oxide to sulfopolyester ranges from 1:20 to 1:150.

28. The light-sensitive photographic element of claim 24 wherein the antistatic layer has a coating weight in the range of 10 $mg/m^2$ to 1 $g/m^2$.

29. The light-sensitive photographic element of claim 24 wherein the silver halide emulsion layer is on the same side of said film base as said antistatic layer.

30. The light-sensitive photographic element of claim 24 wherein the silver halide emulsion layer is on the opposite side of said film base as said antistatic layer.

31. The light-sensitive photographic element of claim 24 wherein the antistatic layer comprises an adhesion promoter.

32. The photographic element of claim 24 in which the sulfopolyester disperses but does not dissolve in aqueous solution.

33. The photographic element of claim 24 in which the amount of colloidal vanadium oxide is no greater than 4.75% by weight of the antistatic layer.

34. A light-sensitive photographic element comprising a polymeric film base, at least one silver halide emulsion layer, and an antistatic layer consisting essentially of a colloidal vanadium oxide and a sulfopolyester adhered to at least one side of said polymeric film base, wherein the weight ratio of vanadium oxide to sulfopolyester is no greater than 1:20.

* * * * *

UNITED STATES PATENT AND TRADEMARK OFFICE

CERTIFICATE OF CORRECTION

PATENT NO. : 5,439,785

DATED : Aug. 8, 1995

INVENTOR(S) : Boston et al.

It is certified that error appears in the above-indentified patent and that said Letters Patent is hereby corrected as shown below:

Column 17, line 67, delete "I" and insert --1--.

Column 18, line 68, delete "I" and insert --1--.

Column 26, line 62, delete "I" and insert --1--.

Column 27, line 1, delete "I" and insert --1--.

Column 32, line 1, delete "claim" and insert --claim 24--.

Signed and Sealed this

Twenty-first Day of November, 1995

Bruce Lehman

*Attest:*

BRUCE LEHMAN

*Attesting Officer*

*Commissioner of Patents and Trademarks*